United States Patent [19]

Allred

[11] Patent Number: 4,676,145

[45] Date of Patent: Jun. 30, 1987

[54] VENTILATING APPARATUS FOR BUILDING FOUNDATIONS IN BOTH BRICK AND SIDING TYPE STRUCTURES

[76] Inventor: Robert F. Allred, 1427 Carolyn Dr., Charlotte, N.C. 28205

[21] Appl. No.: 882,585

[22] Filed: Jul. 7, 1986

[51] Int. Cl.[4] ..... F24F 7/00

[52] U.S. Cl. ..... 98/29; 49/38; 52/198; 52/209; 52/213

[58] Field of Search ..... 98/29, 41.3, 114; 52/198, 199, 207, 209, 213; 49/38

[56] References Cited

U.S. PATENT DOCUMENTS

| | | | |
|---|---|---|---|
| 2,557,566 | 6/1951 | Ronfeldt | 98/29 |
| 2,891,615 | 6/1959 | Farrell | 98/29 |
| 2,995,079 | 8/1961 | LaFontaine | 98/114 |
| 3,220,079 | 11/1965 | Aggson | 98/114 |
| 3,777,649 | 12/1973 | Luckey | 98/29 X |
| 4,274,330 | 6/1981 | Witten et al. | 98/114 X |
| 4,290,554 | 9/1981 | Hensley | 98/29 X |

*Primary Examiner*—Larry I. Schwartz
*Assistant Examiner*—Steven E. Warner
*Attorney, Agent, or Firm*—Shefte, Pinckney & Sawyer

[57] ABSTRACT

A ventilating appartus for installation in a ventilation opening in a building foundation includes a peripheral border having detachable lateral extension tabs for selective retention to be mounted in a mortar joint in brick-type construction and, alternatively, for selective detachment for disposition flush with laterally-adjacent foundation surfaces for edgewise disposition thereon of siding in siding-type building construction. No border is utilized in an alternative embodiment of the ventilating apparatus to facilitate mounting thereof to the outward face of a building foundation as a replacement for broken and deteriorated ventilating apparatus, a separable side portion facilitating such mounting in buildings of siding-type construction. A slotted shutter-like mechanism is provided for convenient opening and closing operation of the ventilating apparatus.

21 Claims, 8 Drawing Figures

VENTILATING APPARATUS FOR BUILDING FOUNDATIONS IN BOTH BRICK AND SIDING TYPE STRUCTURES

BACKGROUND OF THE INVENTION

The present invention relates generally to apparatus for ventilating building foundations and the like and, more particularly, to ventilating apparatus which is selectively openable and closable for mounting in a ventilation opening in a building foundation for controlling ventilating airflow to the foundation.

In the conventional construction of single family homes and similar building structures, it is typical to construct a foundation for the structure by which the lowermost floor surface of the structure is elevated from the supporting ground surface leaving a so-called crawl space within the foundation beneath the floor surface. In such building structures, it is important to provide proper ventilating airflow to the crawl space to permit the exhaustion of heat and moisture prevalent in the summer months so that the risk of mildew, rot and similar damage to the floor structure and other structural members of the building is minimized. On the other hand, it is equally important in the winter months to restrict ventilating airflow to a crawl space in such building structures to provide a generally stagnant insulating air mass within the crawl space to minimize heat loss from the building structure.

One common manner of providing control of the ventilation of a building crawl space is the provision of selectively openable and closable ventilating apparatus in ventilating openings formed at appropriate locations in a building foundation. Perhaps the most widely used form of such ventilating apparatus provides a screen-backed metal grid adapted for mounting in a foundation opening, with a pivoting imperforate plate mounted interiorly of the grid and operated by a chain, wire arm, or the like, extending outwardly through the grid for pivotal movement of the plate toward and away from the grid to open and close it to ventilating airflow therethrough. While such ventilating apparatus have been found to operate effectively for their intended purpose, such apparatus present particular difficulties and problems in installation in both brick-type and wood or other siding-type building construction. As will be understood, in both such types of construction, a brick foundation will ordinarily be provided with the ventilating apparatus typically being mounted within a ventilating opening in the foundation by the use of the cement mortar employed in laying the brick foundation. Conventional ventilating apparatus do not provide any structural support for the laying thereover of a subsequent course or courses of brick following the installation of the ventilating apparatus, so that it ordinarily is necessary to place a metal bar or the like across the ventilator and the uppermost brick course laterally adjacent thereto to provide support for the laying of successive brick courses thereabove. In typical siding-type building construction, no brick course is normally laid over the ventilating apparatus once installed in the brick foundation in the above-described manner and, instead, the wood or other siding is placed edgewise directly on the uppermost brick course laterally adjacent the ventilating apparatus. Hereagain, the conventional ventilating apparatus does not provide suitable support for the siding so as to require the use of a metal bar or the like as above described although such bar disadvantageously obstructs the proper edgewise placement of the siding on such uppermost brick course requiring the siding to be notched or otherwise cut to accommodate the metal bar.

The aforedescribed type of conventional ventilating apparatus are otherwise disadvantageous in that they are generally incapable of regulating the degree of opening or closing for ventilating airflow therethrough. Moreover, experience has shown that such apparatus are subject to breakage or loss of the operating wire or chain and unintended separation of the screen as well as rusting or other decomposition of the pivotal connection of the moving plate whereby over time such apparatus often become inoperable. Additionally, such apparatus are difficult to retrofit into an existing building foundation in replacement of inoperable ventilating apparatus and therefore generally can only be installed in the original construction of a building foundation. A more recently developed type of ventilating apparatus utilizes a thermostatic sensing arrangement for automatically operating opening and closing movement of ventilating openings in relation to the ambient temperature so that manual opening and closing operation of the ventilating apparatus is unnecessary. Such ventilating apparatus also has been found to be effective for its intended purpose but is considered to be relatively expensive and therefore has not achieved widespread use.

In contrast, the present invention provides a manually operable foundation ventilating apparatus of a simple and reliably long-lasting construction adapted for easy installation in the erection of buildings of both brick and siding-type construction. In one embodiment, the ventilating apparatus of the present invention is adapted to be readily utilized as a replacement for broken or otherwise worn or inoperable ventilating apparatus. The present invention also provides a novel opening and closing mechanism permitting the ventilating apparatus to be adjustably set to regulate the degree of opening or closing thereof.

SUMMARY OF THE INVENTION

According to one aspect of the present invention, a ventilating apparatus is provided having a ventilating arrangement selectively openable and closable for respectively permitting and preventing ventilating airflow therethrough, and a border arrangement affixed to the ventilating arrangement for selective mounted positioning of the ventilating apparatus within a ventilation opening in a building foundation having horizontal construction surfaces in collinear relation with one another at opposite lateral sides of the uppermost extent of the ventilation opening, such as in ordinary brick masonry foundation construction. The border arrangement includes a longitudinal side border extending along one longitudinal side of the ventilating arrangement for disposition horizontally uppermost within the ventilation opening. The border arrangement further includes detachable tabs extending in correspondence with the longitudinal side border from its opposite ends outwardly beyond the ventilating arrangement. The tabs may be selectively retained for disposition superposed respectively on the horizontal construction surfaces to facilitate brick-type construction of the building with a brick course superposed directly on the longitudinal side border with the tabs in correspondence to a mortar joint between the horizontal construction surfaces and the brick course. Alternatively, the tabs may be selectively detached for disposition of the longitudinal side border collinearly flush with the horizontal construction surfaces to facilitate siding-type construction of the building with siding superposed edgewise on the longitudinal side border and the horizontal construction surfaces.

Preferably, the ventilating arrangement is of a substantially rectangular configuration, the longitudinal side border extending linearly along one longitudinal side of the ventilating arrangement and the border arrangement further including a pair of side borders extending perpendicularly to the longitudinal side borders along the opposite lateral sides of the ventilating arrangement for upright disposition within opposite lateral sides of the ventilation opening. The longitudinal side border is of a sufficient dimension transversely of its longitudinal extent to support a conventional construction brick on a stacking surface thereof. A score line is formed transversely intermediate the longitudinal side border and each of the tabs and aligned with the respective adjacent transverse side border to facilitate detachment of the tabs flush with the respective adjacent transverse side border.

According to another aspect of the present invention, a ventilating apparatus is provided which is particularly adapted for installation as a replacement of existing ventilation apparatus mounted in a ventilation opening in a building foundation. This ventilating apparatus basically includes a generaly planar mounting plate for stationary affixation to the face of the building foundation outwardly of the ventilation opening in covering relation thereto. The mounting plate includes a plurality of openings therein with a screen affixed to one side of the mounting plate for facing the building foundation in covering relation to the openings for permitting airflow therethrough while otherwise substantially restricting passage of objects therethrough. An operating plate having a plurality of openings therein is movably mounted to the opposite side of the mounting plate in substantially parallel surface abutment therewith for parallel sliding movement with respect to the mounting plate. The operating plate is capable of sliding movement between an open position wherein its opening are in correspondence with the openings of the mounting plate for permitting ventilating airflow therethrough and a closed position wherein the openings of the operating plate are out of correspondence with the openings of the mounting plate for preventing airflow therethrough.

Preferably, the mounting plate includes a peripheral border for substantially continuous generally sealing contact with the building foundation face with one side portion of the mounting plate being selectively detachable to accommodate unobstructed mounting to the building foundation face in a variety of differing building constructions. The openings in the mounting plate preferably are in the nature of rectangular ventilation slots formed at longitudinal spacings along the mounting plate. A pair of threaded support studs project outwardly from the aforesaid opposite side of the mounting plate adjacent its opposite longitudinal ends. The operating plate is also substantially planar with its openings similarly formed as a plurality of rectangular ventilation slots longitudinally spaced along the operating plate in correspondence with the ventilation slots of the mounting plate. A pair of longitudinally-extending guide slots are also formed in the mounting plate adjacent its opposite longitudinal ends. In the abutting relationship of the operating and mounting plates, the operating plate receives the support studs through the guide slots in the operating plate, the guide slots defining the degree of sliding movement of which the operating plate is capable. A pair of retaining nuts are respectively affixed to the projecting ends of the support studs at the side of the operating plate opposite the mounting plate for retaining the operating plate in its parallel surface abutment with the mounting plate and for tightening the operating plate as desired in the open or closed position or an intermediate position. A knob is affixed to the operating plate for permitting selective manual actuation of its sliding movement between its open and closed positions and selective setting of the operating plate at any desired position.

DESCRIPTION OF THE PREFERRED EMBODIMENT

Figure 1:
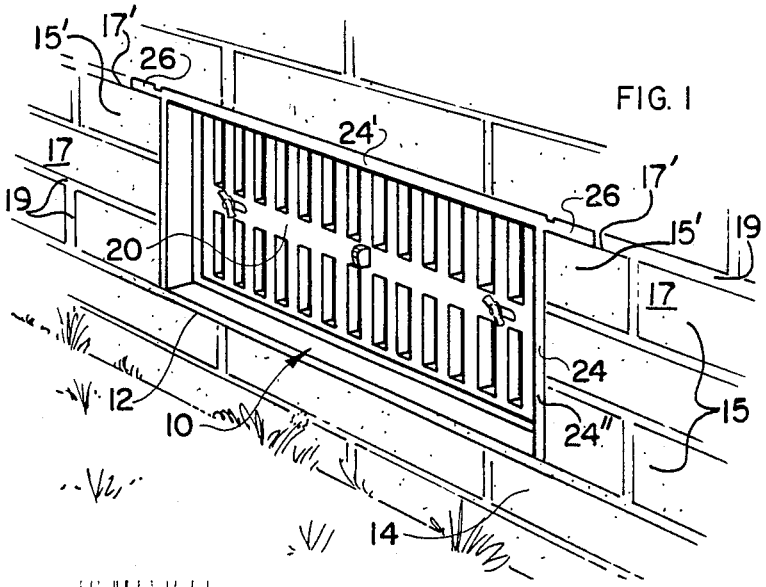
FIG. 1 is a perspective view of the preferred embodiment of the present ventilating apparatus installed in a ventilation opening in a building foundation of a building of brick-type construction.
Figure 2:
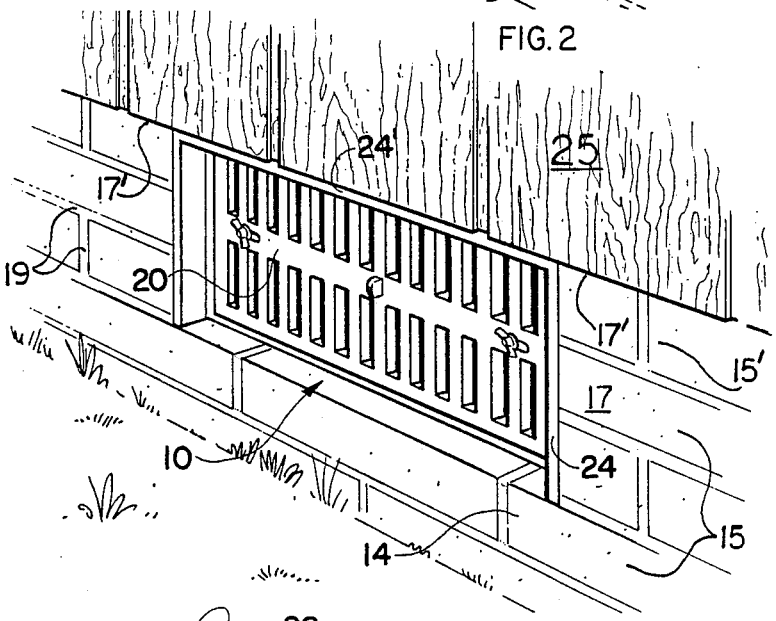
FIG. 2 is another perspective view of the preferred embodiment of the present ventilating apparatus installed in a ventilation opening in a foundation of a building of siding-type construction.

Referring now to the accompanying drawings and initially to FIGS. 1 and 2, the preferred embodiment of the ventilating apparatus of the present invention is indicated generally at 10 as preferably installed alternatively in ventilation openings 12 in building foundations 14 representative of that of typical single family homes of brick-type construction, as shown in FIG. 1, and of siding-type construction, as shown in FIG. 2. As used herein, the term "brick" is intended to generically define and include any masonry building block having parallel stacking surfaces suitable to enable the building block to be used in home and other type building construction. The term "siding" is similarly intended to generically define and include any type of planar or substantially planar sheet-like or board-like building material of wood or any other suitable material adapted for use as an exterior wall surface in home or other building structures.

In each such type of construction, as shown in FIGS. 1 and 2, the foundation 14 is of a brick-type construction formed of plural successive stacked courses 15 of bricks 17 joined by intermediate horizontal and vertical mortar joints 19, the foundation 14 supporting an elevated floor structure (not shown) to provide a crawl space beneath the floor structure within the confines of the foundation 14. The ventilation opening 12 is formed by laterally spacing bricks 17 in three successive courses. As will be understood, the uppermost brick course 15' laterally defining the ventilation opening 12 presents horizontal upwardly-facing stacking surfaces 17' in coplanar relation with one another at the opposite lateral sides of the ventilation opening 12. In the conventional manner of typical present-day construction of single family homes of brick-type construction, the outward brick veneer wall surface of the home is formed by the continued successive stacked formation of further brick courses 15 upwardly from the uppermost brick course 15' laterally adjacent the ventilation opening 12. In the conventional construction of homes of siding-type construction, the formation of the brick foundation 14 is completed at the brick course 15' with the siding 25, normally a wood or composition board, being mounted along one longitudinal edge superposed on the upwardly-facing stacking surfaces 17' of the uppermost brick course 15'. As will be explained, the ventilating apparatus 10 is uniquely suited to be mounted in the ventilation opening 12 formed in either type of conventional construction.

Figure 3:
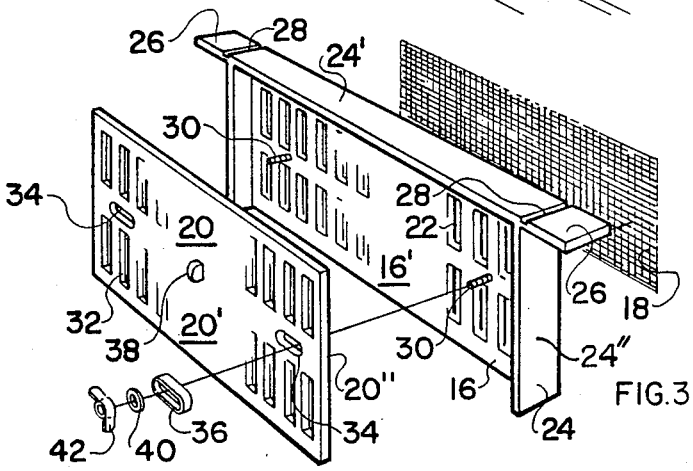
FIG. 3 is a perspective exploded view of the ventilating apparatus of FIG. 1.

As best seen in FIG. 3, the ventilating apparatus basically includes a mounting plate 16, a screen 18, and an operating plate 20. The mounting plate 16 is of a rectangular, substantially planar, plate-like construction formed of sheet metal, plastic or another suitable material. A plurality of transversely-extending rectangular slots 22 are formed through the mounting plate 16 in two rows extending longitudinally along the mounting plate 16 at substantially equal longitudinal and transverse spacings. A flange-like peripheral border 24 extends transversely outwardly beyond each face of the mounting plate 16 from one longitudinal side edge and both transverse side edges of the mounting plate 16, the border 24 being of a transverse widthwise dimension slightly less than that of the stacking and end surfaces of a conventional brick 17. The border 24 includes a pair of extension tabs 26 respectively extending outwardly beyond the opposite longitudinal ends of the mounting plate 16 in substantially coplanar relation with the longitudinal side section 24' of the border 24. A score line 28 is formed transversely in each extension tab 26 between the longitudinal border section 24' and the extension 26 in alignment with the respective adjacent transverse side section 24'' of the border 24 to permit the extension tabs 26 to be readily separated from the border 24 flush with the transverse side section 24''.

The screen 18 is preferably a relatively coarse gauge inflexible wire mesh hardware screen of a substantially planar rectangular configuration, although as those persons skilled in the art will readily recognize, substantially any conventional form of screen material may be utilized. The screen 18 is affixed to the rearward side face (not shown) of the mounting plate 16 in covering relation to the slotted openings 22 therein. In this manner, the screen 18 permits ventilating airflow through the slotted openings 22 while otherwise substantially restricting and preventing objects and other material from passing through the openings 22. A pair of threaded studs 30, which may be bolts or any other suitable threaded member, are affixed to the mounting plate 16 adjacent its opposite longitudinal ends intermediate the two rows of slotted openings 22 and project perpendicularly outwardly from the forward side face 16' of the mounting plate 16.

The operating plate 20 is of a similar substantially planar, rectangular, plate-like construction to that of the mounting plate 16 but is of slightly smaller transverse and longitudinal dimensions than those of the mounting plate 16. A plurality of transversely-extending rectangular slots 32 are formed through the operating plate 20 in two longitudinally-extending rows of the slots 32 spaced transversely and longitudinally in correspondence to the slotted openings 22 in the mounting plate 16. A pair of elongated oval-shaped guide slots 34 are formed through the operating plate 20 adjacent its opposite longitudinal ends intermediate its two rows of slots 32, with each elongated guide slot 34 having a brass grommet 36 fitted snugly therein. An operating knob 38 is affixed to and extends outwardly from one side face 20' of the operating plate 20.

Figure 4:
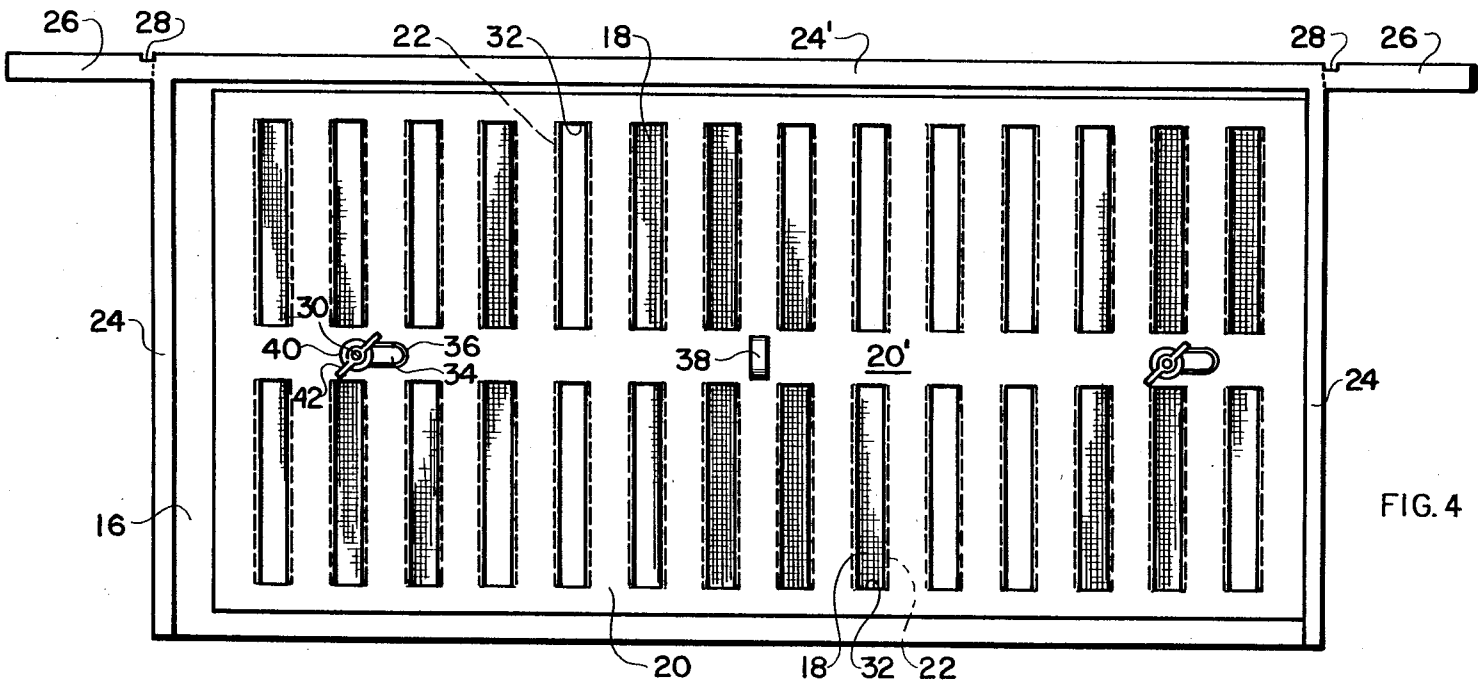
FIG. 4 is a front elevational view of the ventilating apparatus of FIG. 1 with the operating plate in its open position.
Figure 5:
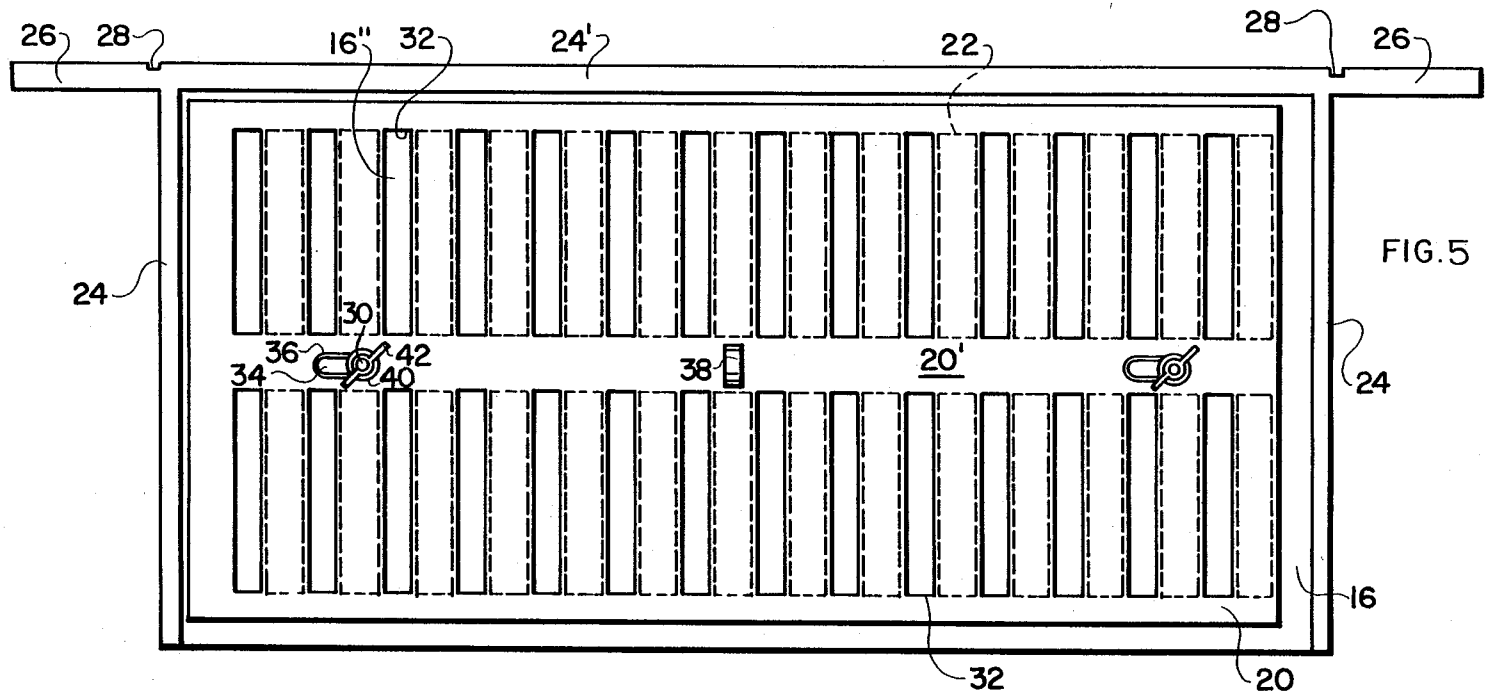
FIG. 5 is a front elevational view of the ventilating apparatus similar to FIG. 4, showing the operating plate in its closed position.

The operating plate 20 is mounted to the mounting plate 16 with the rearward side face 20'' of the operating plate 20 in substantially flush parallel abutment with the forward side face 16' of the mounting plate 16 and with the threaded support studs 30 of the mounting plate 16 extending outwardly through and beyond the guide slots 34 in the operating plate 20. A washer 40 and a wing nut 42 are affixed to the projecting end of each support stud 30 to retain the operating plate 20 in parallel abutment with the mounting plate 16. As desired, the wing nuts 42 may be tightened against the operating plate 20 to secure it in a fixed disposition with respect to the mounting plate 16 or the wing nuts 42 may be loosened so that the operating plate 20 is capable of parallel sliding movement longitudinally with respect to the mounting plate 16 within the limits defined by the grommets 36 fitted within the guide slots 34. Specifically, each of the grommets 36 define a lengthwise receiving opening for the support studs 30 adapted to closely constrain the operating plate 20 to sliding movement between an open position with respect to the mounting plate 16, as shown in FIG. 4, and a closed position with respect to the mounting plate 16, as shown in FIG. 5. In the open position of the operating plate 20, the slots 32 of the operating plate 20 register in exact overlying correspondence with the slotted openings 22 through the mounting plate 16 in order to permit ventilating airflow through the slots 32,22 and through the screen 18. In the closed position of the operating plate 20, the slots 32 of the operating plate 20 are fully out of correspondence with the slotted openings 22 of the operating plate 20 and, instead, the slots 32 overly the portions of the mounting plate 16 longitudinally intermediate its slotted openings 22 for substantially preventing airflow through the slots 32,22. The knob 38 on the outward face 20' of the operating plate 20 permits selective manual actuation of the sliding movement of the operating plate 20 between its open and closed positions.

The installation and operation of the present ventilating apparatus 10 will thus be understood. As previously mentioned, the border 24, particularly its detachable extension tabs 26, uniquely facilitates the installation of the ventilating apparatus 10 in the foundation opening 12 both in homes and other buildings of a brick-type construction, as shown in FIG. 1, and in homes and buildings of an siding-type construction, as shown in FIG. 2. Specifically, in a home of a brick-type construction, the extension tabs 26 of the border 24 are retained and are positioned to extend laterally beyond the lateral sides of the ventilation opening 12 to rest superposed respectively on the upwardly facing stacking surfaces 17′ of the bricks 17 in the uppermost brick course 15′ immediately laterally adjacent the foundation ventilating opening 12 in correspondence to the mortar joint formed between the brick course 15′ and the next successive upwardly-adjacent brick course 15 thereafter laid. The transverse side sections 24″ of the border 24 provide abutment surfaces against which the bricks 17 laterally defining the ventilation opening 12 abut and may be sealingly joined by a vertical mortar joint as necessary. The longitudinal side section 24′ of the border 24, in conjunction with the horizontal mortar joint immediately above the brick course 15′, forms a planar stacking surface on which the next successive brick course 15 may be laid. The lowermost edge of the mounting plate 16 of the ventilating apparatus 10 is sealed by a suitable horizontal mortar joint to the last complete brick course 15 defining the lowermost extent of the foundation ventilation opening 12. On the other hand, in homes and other buildings of siding-type construction, the extension tabs 26 are removed along the score lines 28 to form a substantially ninety degree corner between each end of the longitudinal side section 24′ and the respective adjacent transverse side sections 24″ of the border 24. In this manner, the ventilating apparatus 10 may be positioned within the foundation 12 with the upwardly-facing surface of the longitudinal side section 24′ in flush coplanar relation with the upwardly-facing stacking surface 17′ of the uppermost brick course 15′, by eliminating or minimizing the horizontal mortar joint between the lowermost edge of the mounting plate 16 of the ventilating apparatus 10 and the last complete brick course 15 defining the lowermost extent of the ventilation opening 12. Thus, the upwardly-facing surface of the longitudinal side section 24′ of the border 24 and the adjacent coplanar stacking surface 17′ cooperatively provide a substantially planar surface on which the siding 25 may be mounted in edgewise superposed relation.

Advantageously, the detachable extension tabs 26 of the present ventilating apparatus 10 greatly simplify the manner of installation of the present ventilating apparatus 10 over conventional ventilting apparatus described above by eliminating the need for the use of any metal bar or other auxiliary support surface above the ventilating apparatus 10 on which the next successive brick course or the siding may be positioned. Instead, the longitudinal side section 24′ of the border 24 performs such function as an integral component of the ventilating apparatus 10. Moreover, the conventional need in siding-type construction to notch or otherwise cut out a section of the siding to accommodate the metal stacking bar, is totally eliminated and thereby provides a neater and more attractive appearance to this type of construction.

The ventilating apparatus 10 is furthermore of a substantially simple construction which will provide reliable ventilating operation over considerable lengths of time with little, if any, necessary maintenance or repairs. The sliding movement of the operating plate 20 provides positive opening and closing of the ventilating apparatus 10 and also, if necessary, permits ready disassembly of the operating plate 20 from the mounting plate 16 for cleaning, repairs or like maintenance. In addition, the slidability of the operating plate 20 and the provision of the correspondingly spaced slots 22,32 in the mounting and operating plates 16,22 readily permits either full opening of the slots 22,32 complete closing thereof, or substantially any degree of partial opening or closing between such positions so that the amount of permissible ventilating airflow through the apparatus 10 may be relatively precisely regulated. The screen 18 is of a substantially stronger and more rigid construction than the screens utilized in conventional ventilating apparatus so as to substantially prevent any tearing or unintended separation of the screen 18 from the ventilating apparatus 10. The simple and reliable construction of the ventilating apparatus 10 also enables it to be manufactured and sold inexpensively in relation to comparable conventional ventilating apparatus.

Figure 6:
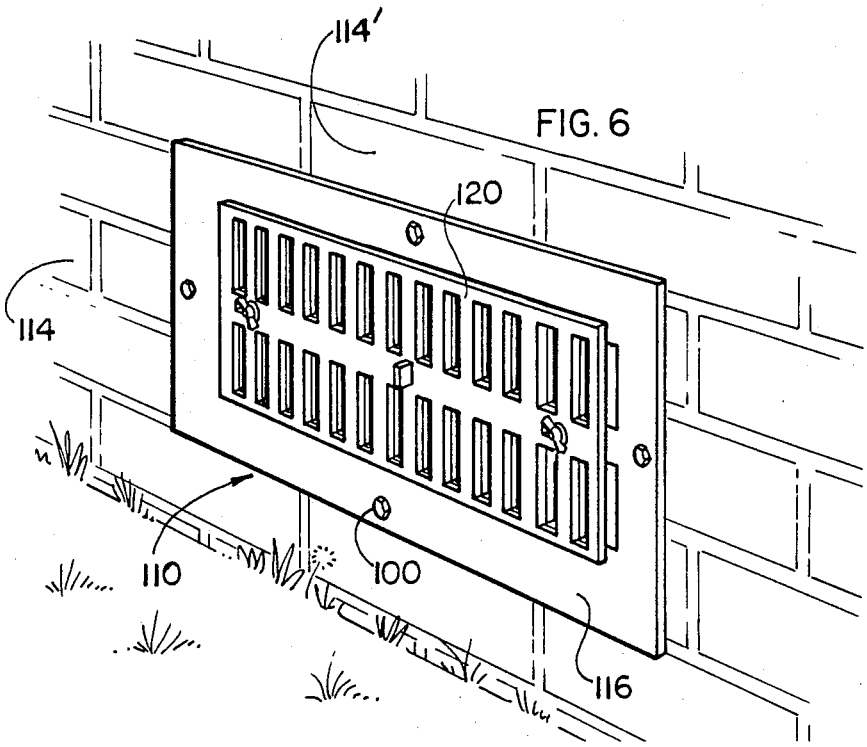
FIG. 6 is a perspective view of another embodiment of the present ventilating apparatus in a replacement installation in covering relation over a ventilation opening in a building foundation of brick-type construction.
Figure 7:
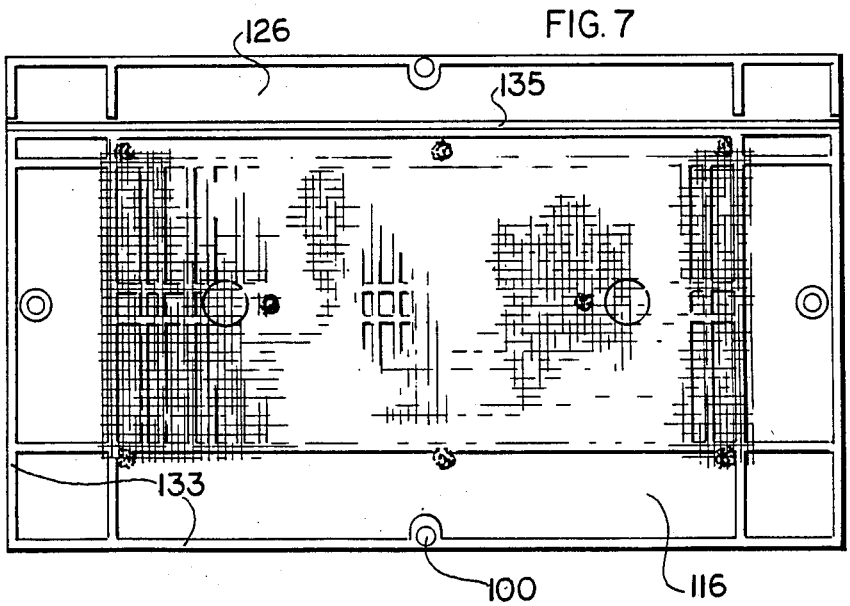
FIG. 7 is a rear side elevational view of the ventilating apparatus of FIG. 6.
Figure 8:
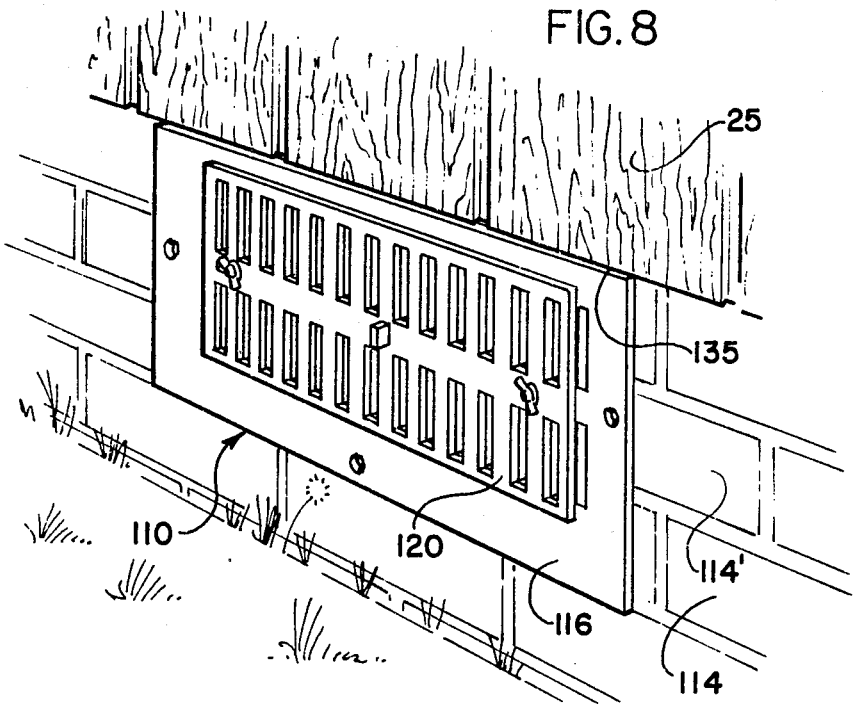
FIG. 8 is a perspective view of the ventilating apparatus of FIG. 6 in a replacement installation on a foundation of a building of siding-type construction.

Referring now to FIGS. 6 and 7, another embodiment of the ventilating apparatus of the present invention is indicated generally at 110. For convenient reference, the components of the ventilating apparatus 110 which correspond to those of the ventilating apparatus 10 are identified by corresponding reference numerals in the 100 series of numerals. The ventilating apparatus 110 basically differs from the ventilating apparatus 10 in the elimination of the border 24 and the enlargement of the mounting plate 116 in both its longitudinal and widthwise dimensions to be of a greater rectangular size than the generally standardized foundation ventilation openings 12 which have in the past been utilized in building construction. In this manner, the ventilating apparatus 10 provides for simple, inexpensive and rapid replacement of conventional ventilating apparatus in existing building structures simply by the removal of the existing ventilating apparatus from its foundation opening and the subsequent affixation of the ventilating apparatus 110 to the outward face 114′ of the building foundation 114 in covering relation over the ventilating opening therein. For this purpose, the mounting plate 116 has a plurality of openings 100 formed therethrough along the outward peripheral edges thereof for receipt of appropriate bolts, screws or other fasteners for mounting the ventilating apparatus 110 in place. As seen in FIG. 7, the mounting plate 116 is formed with a score line 135 extending the full length of the mounting plate 116 at a small spacing from one longitudinal edge 116′ thereof to facilitate the selective detachment of a side portion 126 from the mounting plate 116 to facilitate mounting of the ventilating apparatus 110 over foundation openings in homes and buildings of siding-type construction. Specifically, detachment of the side portion 126 enables the mounting plate 116 to be affixed to the outward foundation face 114′ in such a home or building with the edge of the mounting plate 116 formed by detachment of the side portion 126 abutted against the downwardly-facing edge of the siding for disposition of the mounting plate 116 flush against the outward foundation face 114′ with the slotted areas of the mounting and operating plates 116,120 in direct correspondence with the foundation ventilating opening. Preferably, the rearward face of the mounting plate 116 has a peripheral bead or border 133 to facilitate substantially continuous generally sealing contact with the building foundation face 114′.

It will therefore by readily undestood by those persons skilled in the art that the present invention is susceptible of a broad utility and application. Many embodiments and adaptations of the present invention other than those herein described, as well as many variations, modifications and equivalent arrangements will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

I claim:

1. A ventilating apparatus for selective mounting disposition in a ventilation opening in a building foundation having horizontal construction surfaces in collinear relation with one another at opposite lateral sides of the uppermost extent of the ventilation opening, said ventilating apparatus being adapted for use in buildings of both siding-type construction wherein a lowermost edge of building siding defines the uppermost extent of the ventilation opening and brick-type construction wherein a course of bricks defines the uppermost extent of the ventilation opening, said ventilating apparatus comprising:

ventilating means for positioning in a ventilation opening in a building foundation and being selectively openable and closable for respectively permitting and preventing ventilating air flow therethrough, and border means affixed to said ventilating means for positioning said ventilating apparatus within said ventilation opening, said border means including a longitudinal side border along one longitudinal side of said ventilating means for disposition horizontally uppermost within the ventilation opening, said border means including a pair of detachable tabs extending in correspondence with said longitudinal side border from its opposite ends outwardly beyond said ventilating means and a transverse score line intermediate said longitudinal side border and each said tab to facilitate selective detachment thereof flush with respectively adjacent lateral side portions of said ventilating means, said score line permitting selective retention of said tabs for disposition superposed respectively on the horizontal construction surfaces to facilitate brick-type construction of the building with a brick course superposed directly on said longitudinal side border with said tabs in correspondence to a mortar joint between the horizontal construction surfaces and the brick course and selective detachment of said tabs for disposition of said longitudinal side border collinearly flush with the horizontal construction surfaces to facilitate siding-type construction of the building with siding superposed edgewise on said longitudinal side border and the horizontal construction surfaces.

2. A ventilating apparatus according to claim 1 and characterized further in that said longitudinal side border is of a sufficient dimension transversely of its longitudinal extent to support a conventional construction brick on a stacking surface thereof.

3. A ventilating apparatus according to claim 1 and characterized further in that said ventilating means comprises:

a substantially planar mounting plate having a plurality of rectangular ventilation slots formed at longitudinal spacings therealong;

a screen affixed to one side of said mounting plate in covering relation to said ventilation slots for permitting air flow therethrough while otherwise substantially restricting passage of objects therethrough;

a pair of threaded support studs projecting outwardly from the opposite side of said mounting plate adjacent opposite longitudinal ends thereof;

a substantially planar operating plate having a plurality of rectangular ventilation slots formed at longitudinal spacings therealong in correspondence with said ventilation slots of said mounting plate and having a pair of longitudinally-extending guide slots formed adjacent opposite longitudinal ends of said operating plate;

said operating plate being mounted to said mounting plate in substantially parallel surface abutment with said opposite side thereof with said support studs received through said guide slots;

said guide slots permitting limited parallel sliding movement of said operating plate with respect to said mounting plate between an open position wherein said ventilation slots of said operating plate are in correspondence with said ventilation slots of said mounting plate for ventilating air flow therethrough and a closed position wherein said ventilation slots of said operating plate are out of correspondence with said ventilation slots of said mounting plate for preventing air flow therethrough;

a pair of retaining nuts respectively affixed to the projecting ends of said support studs at the side of said operating plate opposite said mounting plate for retaining said operating plate in parallel surface abutment with said mounting plate; and a knob affixed to said operating plate for selective manual activation of its sliding movement between its said open and closed positions.

4. A ventilating apparatus according to claim 1 and characterized further in that said border means includes a pair of side borders extending transversely to said longitudinal side border along opposite ends of said ventilating means for upright disposition within opposite lateral sides of the ventilation opening.

5. A ventilating apparatus according to claim 4 and characterized further in that each said tab is detachable flush with the respective adjacent transverse side border.

6. A ventilating apparatus according to claim 5 and characterized further in that said score lines of said border means are aligned with the respective adjacent transverse side border to facilitate detachment of said tabs.

7. A ventilating apparatus according to claim 6 and characterized further in that said longitudinal side border is of a sufficient dimension transversely of its longitudinal extent to support a conventional construction brick on a stacking surface thereof.

8. A ventilating apparatus according to claim 7 and characterized further in that said transverse side borders are of transverse dimensions corresponding to said longitudinal side border.

9. A ventilating apparatus according to claim 7 and characterized further in that said ventilating means is of a substantially rectangular configuration, said longitudinal side border extending linearly along one longitudinal side of said ventilating means and said transverse side borders extending perpendicularly along the opposite lateral sides of said ventilating means.

10. A ventilating apparatus according to claim 1 and characterized further in that said ventilating means comprises:

a mounting plate for stationary affixation in a ventilation opening in a building foundation, said mounting plate having a plurality of openings therein;

screen means affixed to said mounting plate covering said openings for permitting air flow therethrough while otherwise substantially restricting passage of objects therethrough; and an operating plate having a plurality of openings therein, said operating plate being movably mounted to said mounting plate in substantially parallel surface abutment therewith for parallel sliding movement with respect thereto between an open position wherein said openings of said operating plate are in correspondence with said openings of said mounting plate for ventilating air flow therethrough and a closed position wherein said openings of said operating plate are out of correspondence with said openings of said mounting plate for preventing air flow therethrough.

11. A ventilating apparatus according to claim 10 and characterized further in that said openings in each of said mounting plate and said operating plate are formed as rectangular slots arranged in correspondingly spaced linear rows.

12. A ventilating apparatus according to claim 10 and characterized further in that said screen means is affixed to one side of said mounting plate and said operating means is mounted to the opposite side of said mounting plate.

13. A ventilating apparatus according to claim 10 and characterized further by guide means for constraining sliding movement of said operating plate between said open and closed positions, said guide means including slot means formed in said operating plate and projection means affixed to said mounting plate and extending outwardly therefrom through said slot means.

14. A ventilating apparatus according to claim 13 and characterized further by a handle affixed to said operating plate for manual activation of its sliding movement.

15. A ventilating apparatus according to claim 13 and characterized further in that said slot means includes a plurality of slots formed in said operating plate, and said projecting means includes a respective plurality of threaded studs and a plurality of retaining nuts affixed to the projecting ends of said studs for retaining said operating plate in parallel surface abutment with said mounting plate.

16. A ventilating apparatus particularly adapted for replacement of existing ventilating apparatus mounted in a ventilation opening in a building foundation in buildings of both siding-type construction wherein a lowermost edge of building siding defines the uppermost extent of the ventilation opening and brick-type construction wherein a course of bricks defines the uppermost extent of the ventilation opening, said ventilating apparatus comprising:

a generally planar mounting plate for stationary affixation to the face of the building foundation outwardly of the ventilation opening in covering relation to the ventilation opening, said mounting plate having a plurality of openings therein;

screen means affixed to one side of said mounting plate for facing the building foundation in covering relation to said openings for permitting air flow therethrough while otherwise substantially restricting passage of objects therethrough; and an operating plate having a plurality of openings therein, said operating plate being movably mounted to the opposite side of said mounting plate in substantially parallel surface abutment therewith for parallel sliding movement with respect thereto between an open position wherein said openings of said operating plate are in correspondence with said openings of said mounting plate for ventilating air flow therethrough and a closed position wherein said openings of said operating plate are out of correspondence with said openings of said mounting plate for preventing air flow therethrough;

said mounting plate including a longitudinal score line extending along one longitudinal side portion of said mounting plate to define a selectively detachable longitudinal side portion for selective detachment of said side portion to facilitate unobstructed flush mounting of said mounting plate to the building foundation face in buildings of siding-type construction with said score line in abutment against the lowermost edge of siding and for selective retention of said side portion for flush mounting to the building foundation face in buildings of brick-type construction with said longitudinal side portion in covering relation to the course of bricks above the ventilation opening.

17. A ventilating apparatus according to claim 16 and characterized further in that said mounting plate includes a peripheral border for substantially continuous generally sealing contact with the building foundation face.

18. A ventilating apparatus according to claim 16 and characterized further in that said openings in each of said mounting plate and said operating plate are formed as rectangular slots arranged in correspondingly spaced linear rows.

19. A ventilating apparatus according to claim 16 and characterized further by guide means for constraining sliding movement of said operating plate between said open and closed positions, said guide means including slot means formed in said operating plate and projection means affixed to said mounting plate and extending outwardly therefrom through said slot means.

20. A ventilating apparatus according to claim 19 and characterized further by a handle affixed to said operating plate for manual activation of its sliding movement.

21. A ventilating apparatus according to claim 19 and characterized further in that said slot means includes a plurality of slots formed in said operating plate, and said projecting means includes a respective plurality of threaded studs and a plurality of retaining nuts affixed to the projecting ends of said studs for retaining said operating plate in parallel surface abutment with said mounting plate.

* * * * *